United States Patent [19]

Little et al.

[11] 4,296,677

[45] Oct. 27, 1981

[54] TANDEM HYDRAULIC ACTUATOR

[75] Inventors: Jane Little, Long Beach; Del F. Greene, Los Angeles, both of Calif.

[73] Assignee: McDonnell Douglas Corporation, Long Beach, Calif.

[21] Appl. No.: 51,815

[22] Filed: Jun. 25, 1979

[51] Int. Cl.[3] ..... F15B 13/00

[52] U.S. Cl. ..... 91/510; 91/519; 92/108; 92/118; 92/151

[58] Field of Search ..... 92/107, 108, 113, 118, 92/151; 91/509, 510, 519, 533

[56] References Cited

U.S. PATENT DOCUMENTS

| | | | |
|---|---|---|---|
| 1,088,334 | 2/1914 | Edgar | 02/113 |
| 1,612,779 | 12/1926 | Mercer | 92/151 |
| 1,832,618 | 11/1931 | Conklin | 92/113 |
| 2,505,771 | 5/1950 | Hoar | 91/533 |
| 2,637,944 | 5/1953 | Claughsey | 92/151 |
| 2,698,605 | 1/1955 | Kress | 92/108 |
| 2,743,703 | 5/1956 | Miller | 92/151 |
| 2,851,994 | 9/1958 | Fagge | 92/152 |
| 2,932,206 | 4/1960 | Tootle | 92/151 |
| 2,956,549 | 10/1960 | Malpass | 92/152 |
| 2,982,257 | 5/1961 | Fagge | 92/152 |
| 3,190,185 | 6/1965 | Rasmussen . | |
| 3,220,317 | 11/1965 | Fuell . | |
| 3,295,420 | 1/1967 | Gleason | 91/216 |
| 3,358,565 | 12/1967 | Townsend | 92/151 |
| 3,543,641 | 12/1970 | Deplante | 91/361 |
| 3,554,088 | 1/1971 | Bruyn | 91/533 |
| 3,566,748 | 3/1971 | Mahler | 92/151 |
| 3,584,536 | 6/1971 | Hillberry | 91/533 |
| 3,752,040 | 8/1973 | Pawloski | 92/151 |

*Primary Examiner*—Abraham Hershkovitz
*Attorney, Agent, or Firm*—Paul T. Loef; George W. Finch; Donald L. Royer

[57] ABSTRACT

A linear fluid actuator having two pistons and two cylinder chambers in tandem to provide redundancy when supplied from independent pressure sources. The actuator is balanced in that the actuator output force is equal in extend or retract positions. The two cylinder chambers are made from separate housings to prevent crack propagation between the chambers and dual piston rod construction is provided to enhance redundancy.

10 Claims, 1 Drawing Figure

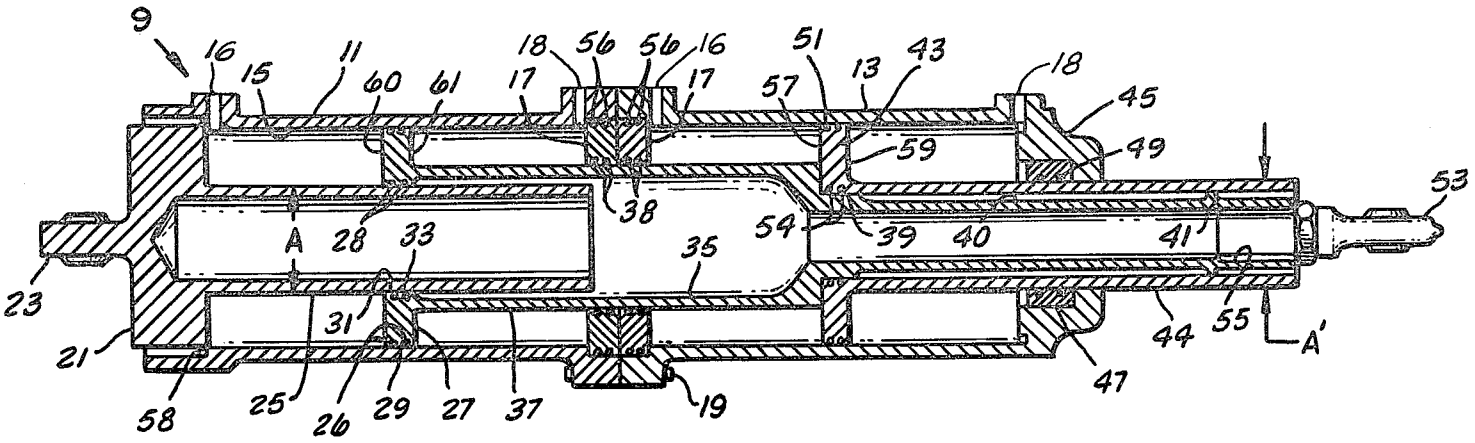
53
A'
55
41
44
45
49
47
18
40
43
59
39
13
51
57
54
16
17
35
19
56
38
56
18
17
37
61
27
33
29
60
28
31
26
11
A
25
15
16
9
58
21
23

TANDEM HYDRAULIC ACTUATOR

STATEMENT OF GOVERNMENT INTEREST

The Government has rights in this invention pursuant to Contract No. NAS-9-15550 awarded by the National Aeronautics and Space Administration.

BACKGROUND OF THE INVENTION

This invention relates to linear fluid actuators and more particularly to actuators employing multiple pistons on a single piston rod.

Many products, including aircraft and spacecraft, require actuators to move some device. In the case of aircraft and spacecraft, the device is often a control surface. One type of actuator is a linear actuator which is so named because it produces linear motion. Representative of linear actuators is the hydraulic or fluid cylinder. Fluid cylinders may be single acting in that fluid pressure is applied to only one side of the piston or double acting where pressure is applied to both sides of the piston. Typically, the double acting cylinder is unbalanced in that equal pressure applied to either side of the piston produces unequal forces because of the area of the piston rod which extends from one side of the piston through the cylinder housing. Conventionally, a double acting cylinder is balanced by providing an external tail rod which is nothing more than a piston rod on both sides of the piston protruding from both ends of the cylinder housing. Usually the external tail rod is covered by extending the cylinder housing and the cylinder attach point is provided at the distal end. This makes the cylinder substantially twice as long, as the total stroke is accommodated at both ends of the cylinder. The conventional method of coping with this problem is to provide an internal tail stock which is nothing more than another rod attached to the cylinder end plate, internal to the cylinder, with a bore through the piston and external rod which slips over the internal tail stock.

However, since the two rods are concentrically engaging, one must necessarily be smaller than the other and the effective piston areas are unbalanced by this differential area.

Frequently in air and space craft it is required that the actuator have a dual or second redundant means of actuation. This is generally provided by a single cylinder with a divider at the midpoint to form two compartments with a piston in each compartment and one common rod through both pistons. To balance this actuator an external tail rod is provided, as discussed above. Again, this makes the actuator very long.

A need arose in a critical space craft application to provide a redundant (dual) balanced double acting linear actuator having an overall length no longer than a single balanced double acting linear actuator and capable of installation within the same space envelope, and without change to the mounting structure. The object of this invention is to satisfy these requirements.

Failures in hydraulic cylinders which are highly stressed, other than packing failures, often occur as fatigue cracks in the cylinder housing. It is a further object of this invention to provide a cylinder housing in which a crack cannot propagate from the first cylinder compartment to the second cylinder compartment.

It is a further objective of the present invention to meet the above objectives within the structure of the actuator itself as opposed to complex and less reliable control means or combinations of electrical and hydraulic actuators as have been taught by others.

SUMMARY OF THE PRESENT INVENTION

In summary, the hydraulic actuator of this invention accomplishes the above objects and overcomes the disadvantages of alternate combined devices by providing a cylindrical housing having multiple chambers to accommodate multiple pistons and having a piston rod connecting the pistons for axial movement in their respective compartments between extend and retract positions. An internal tail rod is provided having an area exactly equal to the external or projecting portion of the piston rod to provide a balanced actuator. The cylinder housing is split to provide separate compartments or cylinder barrels to prevent crack propagation. Dual piston rod construction is provided. To provide further redundancy, two separate sources of hydraulic pressure may be applied to each of the dual chambers.

BRIEF DESCRIPTION OF THE DRAWINGS

With reference to the drawings, wherein like reference numerals designate like portions of the inventions:

The FIGURE is a sectional view, cut along the longitudinal axis, of the balanced tandem actuator.

DETAILED DESCRIPTION OF THE PREFERRED EMBODIMENT

The invention is shown in sectional view in the FIGURE. For purposes of simplicity and orientation, the end of the actuator through which the external piston rod protrudes is identified as the rod end. The opposing, closed end of the actuator, is identified as the head end.

The actuator is a fluid cylinder comprising a head housing 11 and a rod housing 13 having a through bore 15. The through bore 15 is divided by a pair of identical glands 17 which are duplicated simply for purposes of redundancy. The two housings 11 and 13 are joined in tandem, with the glands 17 between, by a series of suitable fasteners shown at 19 to divide the cylinder 9 into a pair of chambers.

The head end wall 21 is provided with an external attachment point 23 which is shown as a spherical self-aligning bearing. However, many alternative attachments are well known in the art. The opposing surface of the head end wall 21 is provided with an internal tail rod having a projected area A at the diameter so indicated.

A head piston 27 is located in the head chamber and has suitable dynamic sealing means 26 and 28 respectively, at the surface 29 and 31 to provide a sliding seal between the piston 27 and the cylinder bore 15 and the tail rod 25 and the piston bore 33.

The piston 27 terminates in a piston rod 35. Rod 35 has a first diameter 37 which extends to a point intermediate the length of the rod 35 sized to allow full stroke within the head chamber. At this intermediate point, the first diameter 37 steps to a reduced diameter 39 shown followed by a relief 40 and terminating in a thread at 41. Dynamic seals at 38 seal the rod diameter 37.

Circumscribing the reduced diameter 39 is the piston 43 attached to the head piston rod 35 via the piston rod 44 at the threaded connection 41. Viewing the assembly of pistons and rods, the piston rod 44 provides a second diameter indicated as A′ and having a projected area A′ equal to the projected area A of the internal tail rod 25 as previously discussed.

Housing 13 terminates in a rod end wall 45 which contains an insert 47 housing the dynamic seal at 49 to enclose the rod end chamber. Dynamic seal means are also located at 51 to seal between the piston 43 and the bore 15 of the housing 13. A spherical rod end 53 is shown threadably connected at 55 as the rod end mounting means. Static seals are shown at 54, 56, and 58.

The cylinder porting means have been identified as extend ports 16 and retract ports 18. Porting is provided to admit hydraulic fluid in both chambers on either side of the pistons 27 and 43 so that the two sides cooperate in moving the piston between its extend and retract positions while the fluid on the opposing surfaces of the pistons is ported to return. It should now be obvious that the sum of the area of the piston surface 60 of the head piston 27 plus the area of the surface 57 of the piston 43 is equal to the area of the surface 59 of the piston 43 plus the surface 61 of the head piston 27. Therefore the actuator is balanced generating equal force in both directions, retract and extend.

To take advantage of the redundancy available, one pressure source is ported to either surface 60 or 61 while an alternate source is ported to surface 57 or 59. Pressure at surfaces 59 and 61 retract the cylinder and, alternately, pressure at surfaces 60 and 57 extend the cylinder, with the non-pressurized surfaces ported to return.

While the actuator is balanced with both pressure sources functioning and both chambers operative if either one chamber is lost or one pressure source is lost the actuator is slightly unbalanced because of the differential area on the two opposing surfaces of a single piston, e.g. 57 and 59. In this mode the actuator performs as a single piston, double acting, internal tail rod cylinder which was discussed earlier as a near balanced actuator. In a six-inch diameter cylinder the near balance exceeds 90%.

It may thus be seen that the piston and chamber arrangement depicted in the preferred embodiment of this invention provides a balanced, redundant, tandem, linear actuator which may be installed in the same spaced envelope and end fittings that accommodate a conventional external rail rod, balanced, single linear hydraulic actuator.

What is claimed is:

1. A fluid actuated cylinder comprising:

a housing having a cylindrical bore;

gland means dividing said cylindrical bore in said housing into a first chamber and a second chamber;

an end wall, having an internal tail rod with an area 'A' closing said second chamber of said housing;

a first piston for movement in said first chamber;

a second piston for movement in said second chamber;

rod means penetrating said gland means, operatively connecting said first piston to said second piston in tandem, said pistons are axially aligned and moveably disposed in their respective chambers to move in cooperation between extend and retract positions with one end of said rod means having a bore to accommodate said internal tail rod, an output rod connected to said first piston having an area 'A', extending from said first chamber;

a rod end wall closing said first chamber of said cylindrical bore in said housing and having a bore therein to accommodate said output rod extending from said first chamber; and means for admitting pressure fluid against a first pressure surface on one side of said first piston and second pressure surface on one side of said second piston while exhausting fluid acting on a third pressure surface on the opposing side of said first piston and fourth pressure surface on the opposing side of said second piston so as to move said pistons in either direction, alternatively, the first and fourth pressure surfaces being equally dimensioned and the second and third pressure surfaces being equally dimensioned, whereby to define a fluid actuated, tandem, linear actuator having redundant chambers and equal combined areas in both extend and retract positions.

2. The fluid actuated cylinder of claim 1 wherein dynamic sealing means are provided between said tail rod and said bore in said rod means, said first piston and said cylindrical bore, said rod means between said first and second pistons and said gland means, said second piston and said cylindrical bore, and said output rod and said bore in said rod end wall.

3. The fluid actuated cylinder of claim 1 wherein means are provided for supplying fluid pressure to said pistons from two independent sources.

4. The fluid actuated cylinder of claim 1 wherein said rod means comprises:

an annular rod with said second piston attached at one distal end of said annular rod followed by a constant second diameter and having a bore at said second piston end to accommodate said internal tail rod and having said first piston, equal in area to said second piston, attached at a point intermediate said rod length where said second diameter steps to a first diameter, said output rod providing a projected end area 'A', which equals the projected end are of said internal tail rod.

5. The fluid actuated cylinder of claim 1 wherein two said gland means are provided, side-by-side, for redundancy.

6. The fluid actuated cylinder of claim 3 wherein said output rod is integral with said first piston and said rod means is integral with said second piston and fastening means for attaching said first piston and said rod means.

7. The fluid actuated cylinder of claim 5 wherein said housing is split between said two gland means and further means are provided to attach said split housings in tandem whereby to provide two separate cylinder housings so that cracks cannot propagate from one chamber to the other.

8. The fluid actuated cylinder of claim 7 wherein said means to attach said split housing in tandem comprises flanges on the butting ends of said split housings and fasteners therethrough.

9. The fluid actuated cylinder of claim 7 wherein said cylinder mounting means are provided on said housing and said rod means.

10. The fluid actuated cylinder of claim 9 wherein said mounting means comprise spherical rod bearings axially located in said endwall and said rod means.

* * * * *